United States Patent [19]

Harris

[11] 4,022,461

[45] May 10, 1977

[54] STAGE PROP

[76] Inventor: Steven Clay Harris, 3902 Nebraska Ave., Nashville, Tenn. 37209

[22] Filed: Feb. 21, 1975

[21] Appl. No.: 551,779

[52] U.S. Cl. ..... 272/22; 52/207

[51] Int. Cl.[2] ..... A63J 1/02

[58] Field of Search ..... 272/25, 21, 22, 23, 272/11; 52/207, 210, 455, 456, 457, 458

[56] References Cited

UNITED STATES PATENTS

| | | | |
|---|---|---|---|
| 389,414 | 9/1888 | Sherwood | 272/22 |
| 437,016 | 9/1890 | Byrnes | 272/25 |
| 1,123,066 | 12/1914 | Barber | 272/11 |
| 1,419,848 | 6/1922 | Hanlon | 272/23 |
| 1,583,775 | 5/1926 | Brandt | 272/11 X |
| 1,818,428 | 8/1931 | Paysen | 272/25 X |
| 1,952,920 | 3/1934 | Hudiakoff | 272/22 |
| 2,052,178 | 8/1936 | Holden | 272/22 |
| 2,060,892 | 11/1936 | Pettit | 52/455 X |
| 2,115,631 | 4/1938 | Gorance | 272/25 X |
| 2,168,922 | 8/1939 | Bayley | 52/207 |
| 2,182,757 | 12/1939 | Gilbert | 272/22 |

*Primary Examiner*—Richard C. Pinkham
*Assistant Examiner*—Arnold W. Kramer
*Attorney, Agent, or Firm*—Abe Hatcher

[57] ABSTRACT

Prop or backdrop for a stage production having a plurality of small hinged doors adapted for actors or puppets appearing therein when open and for painting of scenery on paper, felt or like viewing surface of each to make up a total scene a part of which is presented on each individual door. The backdrop is vertically supported at the rear by a supported platform on which individuals may stand.

1 Claim, 6 Drawing Figures

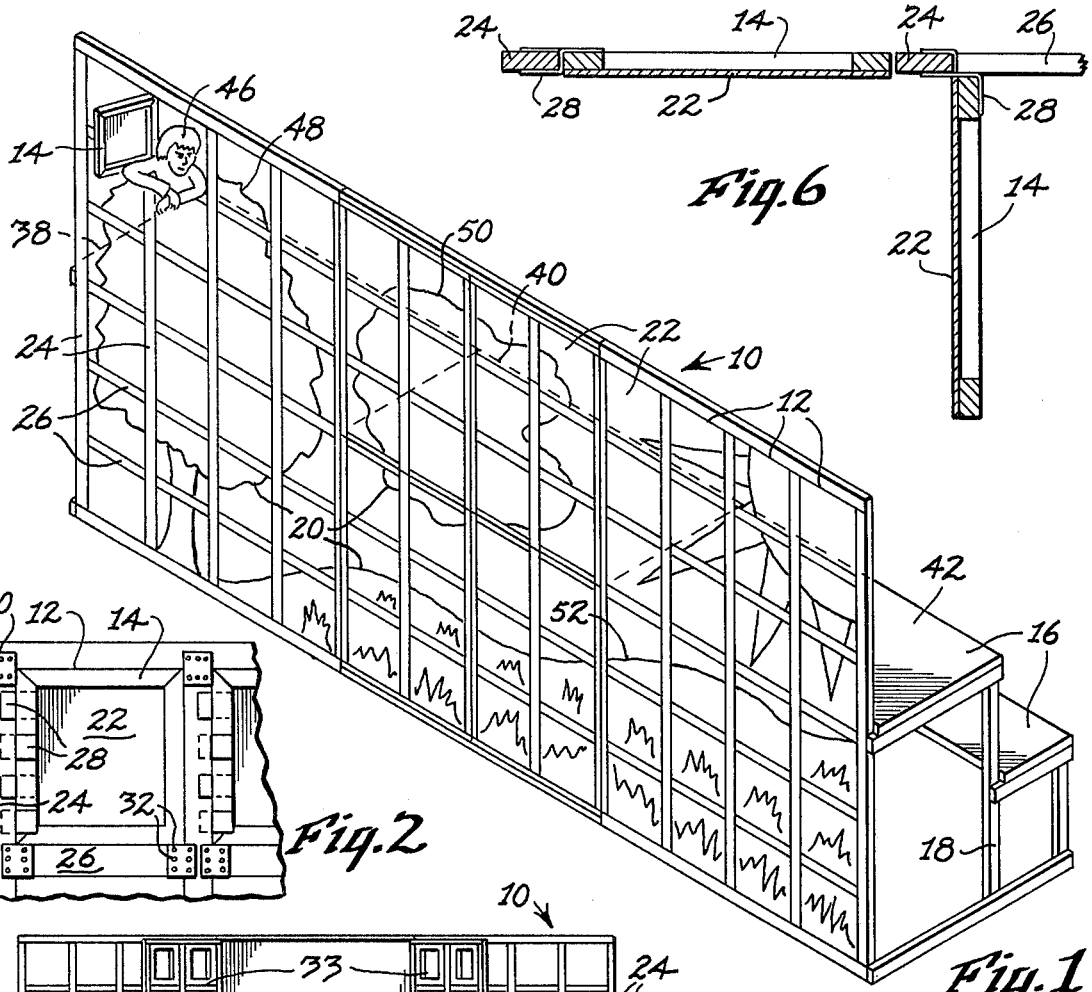
Fig. 1
Fig. 6
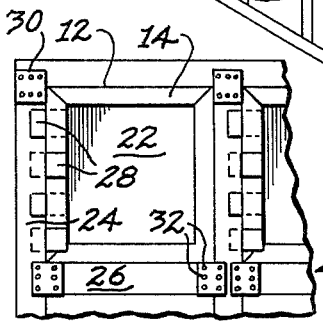
Fig. 2
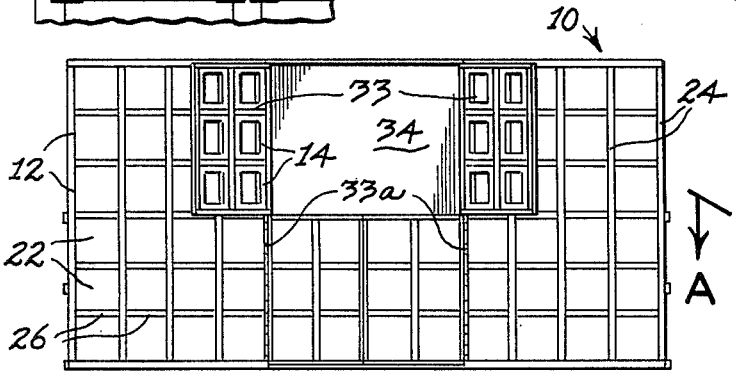
Fig. 3
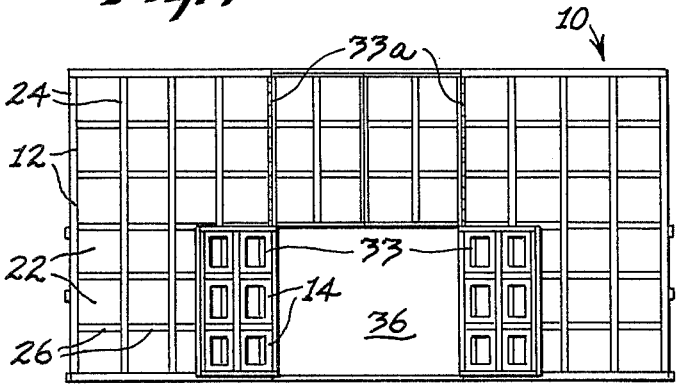
Fig. 4
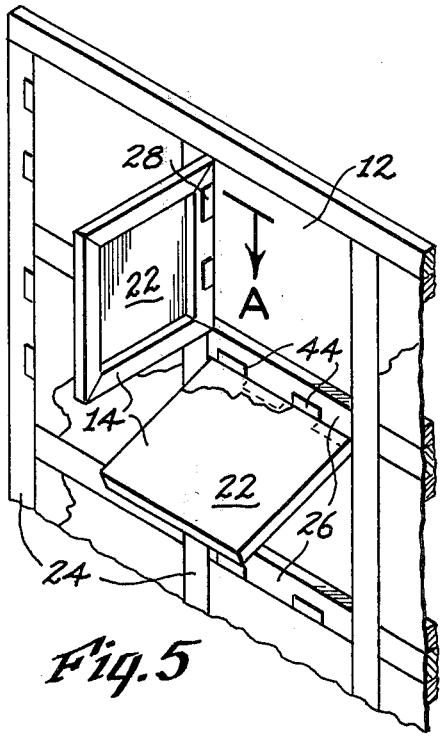
Fig. 5

STAGE PROP

BACKGROUND OF THE INVENTION

1. Field of the Invention

This invention relates to scenery and props for use in presentation of live or puppet plays or still scenes in church, theater or like stage productions. More particularly, it relates to a multicompartment prop or backdrop.

2. Description of the Prior Art

For many years there has been a need for an easily dismantled prop or backdrop for stage productions whereby parts of same could be used for appearance of characters at various locations of scenery painted, printed or otherwise depicted thereon. After extended investigation I have discovered such a prop or backdrop.

SUMMARY OF THE INVENTION

In its broader aspects my invention involves a multicompartment unitary prop or backdrop for a stage production constructed so as to have a plurality of hinged doors therein. The backdrop may be held upright by a support on the side opposite the viewing surface, ordinarily the rear, for example, a step arrangement. There may be one or more steps or platforms in this support upon which individuals may stand to display puppets, their own faces or other appropriate parts of their costume or clothing through one or more of said hinged doors. The individual doors may be of solid wood, metal or like construction, or simply frames with felt, paper or the like held in place thereover by attachment to a framework of which said doors are constructed, for painting, printing or otherwise depicting thereon scenery, lettering or the like. A portion of a total scene, for example, simply the title of a production such as "Jesus", or the like, may be depicted on each of said doors, or an individual character, for example, may appear through one or more of said doors. A better understanding of my invention and how such scenes, puppets, actual faces or the like presented be pesented to an audience thereby may be had by reference to the following description of the drawing which forms a part hereof.

DESCRIPTION OF THE DRAWING

In the drawing:

FIG. 1 is a perspective view from the front or viewing side of the prop or backdrop.

FIG. 2 is a closeup view, from the rear, broken away in section, of a representative door of the prop or backdrop of the invention, including hinges and covering.

FIG. 3 is a front view of the invention showing an embodiment in which two large doors made up several smaller doors are hinged open in the upper half of the backdrop.

FIG. 4 depicts a backdrop similar to that of FIG. 3 except for having the open hinged doors in the lower half thereof.

FIG. 5 is a broken-away front closeup of a four-door section of the backdrop of the invention showing two of the doors hinged open, one sideward and the other downward, for opening upward.

FIG. 6 is a cross-section taken at A—A of FIG. 5.

In the drawing, stage backdrop 10 is made up of a plurality of compartments 12, a plurality of which have hinged doors 14 which may be opened as shown. The backdrop 10 may be held in a substantially upright or perpendicular position by a plurality of properly supported platforms or steps 16 at different heights in the rear held up by braces such as those shown at 18. On front of stage backdrop 10 may be shown a scene such as represented by 20 as painted or printed on a felt, paper, or other-type fibrous covering 22 which may cover each of the doors and substantially the whole front surface of the backdrop except for perpendicular and horizontal supports such as shown respectively at 24 and 26, and which may be seen by an audience to give a stained-glass effect to any scene which may be shown on the backdrop. Upper supports 24 may consist of pieces of lumber 1 inch × 3 inches × 12 feet, and horizontal cross-pieces 26 may be made up of a plurality of individual sections between doors, each of which is made up of a 1 × 3 × 20 inch piece of lumber. As can been seen in most detail in FIGS. 2 and 5, doors 14 may be opened by way of flexible cloth or other-type hinges 28. Cross-pieces 26 may be joined to upright pieces 24 by a piece of keystone ¼-plywood 3 × 3 inches 30, which may be tacked on by ¾ inch nails 32.

FIGS. 3 and 4 show two ways in which double-doors 33, each made up of several of the small doors 14, may be opened simultaneously, for exmple, by hinges 33*a*, to permit actors to appear either in the upper part of the backdrop or the lower part at 34, 36 or to permit showing of a movie on a screen placed in the opening at the upper portion of the middle section 34. The supporting platform 16 may be constructed in a plurality of sections 38, 40 and 42. For example, backdrop doors 14 may be hinged at the top to open upward rather than sideward, for example, as shown in FIG. 5 at hinges 44.

One of the advantages of my stage backdrop is that an actor or puppet 46 may look or appear to an audience as peering through any one of the openings when doors 14 are opened, for example in a religious play to show someone personifying God 46 looking down on the wonders of His creation as shown by trees 48, clouds 50 and terrain 52.

While the invention has been described in terms of preferred embodiments, the claims appended hereto are intended to encompass all embodiments which fall within the spirit of the invention.

Having thus described my invention and certain prefered embodiments thereof, I claim:

1. Scenery for a stage production comprising a backdrop formed of a plurality of detachable sections of substantially equal size, each made up substantially completely of a plurality of substantially rectangular doors, each of said doors comprising a rectangular framework and being hinged on one side of said rectangular framework and having said framework covered on one face thereof except for a sufficient portion on each of the four sides of said rectangular framework to make the checkerboard pattern on said sections and the overall checkerboard pattern of said backdrop visible from the covered side with a fibrous coating having a portion of a complete picture on each door thereon in the manner of a single piece of a multi-piece puzzle, at least one section having larger doors each made up of at least two of said rectangular doors with said larger doors hinged on opposite sides of a rectangle formed thereby so as to meet in the center when closed and open sideward and outward on the covered surface side, and said backdrop being supported in a substantially perpendicular position by a supported platform on the rear non-viewing side away from and out of sight of an audience, said platform comprising a plurality of detachable sections connected along vertical lines along which said detachable backdrop sections are joined.

* * * * *